US006338685B1

(12) United States Patent
Posluszny

(10) Patent No.: US 6,338,685 B1
(45) Date of Patent: Jan. 15, 2002

(54) GOLF BALL AND TEE PLACEMENT DEVICE

(76) Inventor: Frank A. Posluszny, 23 Kent Pl., Cos Cob, CT (US) 06807

( * ) Notice: Subject to any disclaimer, the term of this patent is extended or adjusted under 35 U.S.C. 154(b) by 0 days.

(21) Appl. No.: 09/488,026

(22) Filed: Jan. 20, 2000

Related U.S. Application Data

(60) Provisional application No. 60/117,634, filed on Jan. 28, 1999.

(51) Int. Cl.[7] ..... A63B 57/00
(52) U.S. Cl. ..... 473/386
(58) Field of Search ..... 473/396, 286; 294/19.1, 19.2

(56) References Cited

U.S. PATENT DOCUMENTS

| | | | | |
|---|---|---|---|---|
| 2,609,198 A | | 9/1952 | Armstrong | |
| 4,589,661 A | | 5/1986 | Attig | |
| 4,616,826 A | | 10/1986 | Trefts | |
| 4,714,250 A | | 12/1987 | Henthorn | |
| 4,819,938 A | * | 4/1989 | Hill | 473/386 |
| 4,949,961 A | | 8/1990 | Milano | |
| 4,969,646 A | | 11/1990 | Tobias | |
| 5,080,357 A | | 1/1992 | Wolf | |
| 5,310,177 A | | 5/1994 | Conrad et al. | |
| 5,330,177 A | * | 7/1994 | Rogge | 473/386 |
| 5,503,394 A | * | 4/1996 | Mauck et al. | 473/386 |
| 5,669,646 A | * | 9/1997 | Fiocca et al. | 473/386 |
| 5,672,121 A | * | 9/1997 | Miller | 473/386 |
| 5,707,303 A | * | 1/1998 | Berkowitz et al. | 473/386 |

* cited by examiner

*Primary Examiner*—Steven Wong
(74) *Attorney, Agent, or Firm*—Fattibene & Fattibene; Paul A. Fattibene; Arthur T. Fattibene

(57) ABSTRACT

A main tube having an actuator rod reciprocating therein having a handle portion on one end and a ball and tee holding portion on the other. The ball and tee holding portion has a ball holder or a guide attached to the actuator rod and arms holding the golf tee in position and held by spring clip or leaf springs and magnets. Upon activating the handle portion, the movement of the ball holder and guide causes the release of the pivoted arms after placement of the golf tee in the ground. The ball holder or guide is biased upward by a spring without retracting the arms, thereby permitting the golf tee and ball placement device to be removed from the teed up golf ball. Accurate and repeatable placement of a golf ball at a predetermined height on a tee is achieved with a reduced possibility that the golf ball falls off the tee upon removal of the golf tee and ball placement device.

16 Claims, 16 Drawing Sheets

GOLF BALL AND TEE PLACEMENT DEVICE

RELATED APPLICATION

This application claims the benefit of U.S. Provisional Application No. 60/117,634, filed Jan. 28, 1999.

FIELD OF THE INVENTION

The present invention relates in general to a device that tees up a golf ball, and particularly to assisting the insertion of a golf tee into the ground and placement of a golf ball thereon by a user easily and without having to bend over.

BACKGROUND OF THE INVENTION

The game of golf is very popular, especially among many older individuals. In playing golf, before the start of each hole it is often necessary to place a golf tee in the ground and place a golf ball on the tee. This requires the individual to bend over, insert the golf tee into the ground, and place a golf ball balanced on the golf tee. For some individuals, this is inconvenient and troublesome. There have been several devices developed to aid in the placement of a golf ball on a golf tee. One such device is disclosed in U.S. Pat. No. 4,616,826 entitled "Golf Ball and Tee Setting Apparatus" issuing to Trefts on Oct. 14, 1986. Therein disclosed is a manually operated golf ball teeing unit having a pair of arms pivotally mounted at the base of the unit. The arms are spring biased to engage and support the golf ball on top of a golf tee. A hand operated camming rod pivots the arm against the spring bias to release the ball and tee once positioned. Another device is disclosed in U.S. Pat. No. 5,080,357 entitled "Golf Ball and Tee Setting Device" issuing to Wolf on Jan. 14, 1992. Therein disclosed is a device for setting a golf ball and associated tee in the ground. A pair of articulated jaw assemblies is operated by a handle. Opposing links are caused to pivotally move each jaw assembly outward. Jaw assemblies co-act to hold a golf ball and tee and are released therefrom after the tee has been inserted into the ground. While these devices have been useful in permitting a user to tee up or place a golf ball on a golf tee inserted into the ground without bending over, they are relatively complex and have many parts. Additionally, it is often difficult to manipulate the release of the golf ball and tee and remove the device without causing the golf ball to topple off of the tee. Accordingly, there is a need for a simpler, more easily manufactured device that provides improved release of the golf ball and tee to prevent the golf ball from falling off of the tee once placed thereon.

SUMMARY OF THE INVENTION

The golf tee and ball placement device of the present invention facilitates easy placement of a golf tee and golf ball thereon and removal of the device so as to prevent the golf ball from falling off of the golf tee. An elongated main tube body has an actuator rod placed therein. At one end of the actuator rod is positioned a domed push button and at the other end of the actuator rod is a ball holder or guide. An arm base has two arms pivotally attached thereto that hold a golf tee and golf ball within the ball holder or guide. Leaf springs and magnets hold the arms against the golf tee and ball until released by the downward action of the ball holder or guide. A spring biases the actuator rod upward in a set or ready position. A threaded height adjuster may be used with the device. Additionally, a bubble level may be used in the top handle or domed push button.

Accordingly, it is an object of the present invention to provide a device that can easily place a golf ball on a golf tee without the golfer having to bend over.

It is another object of the present invention to provide a device that reduces the likelihood that a golf ball will fall off of the golf tee upon removing the device.

It is an advantage of the present invention that a golf ball can easily be positioned within the holder and reset for placement on the ground.

It is a further advantage of the present invention that it is easily manufactured and is of relatively simple construction.

It is a feature of the present invention that a golf ball holder or guide is used.

It is another feature of the present invention that arms holding the golf tee and golf ball have releasable spring clips.

It is another feature of the present invention that the arms have multiple surfaces interacting with the spring clips assisting in the secure holding and releasing of the golf ball.

These and other objects, advantages, and features will become readily apparent in view of the following detailed description.

DETAILED DESCRIPTION OF THE PREFERRED EMBODIMENTS

Figure 1:
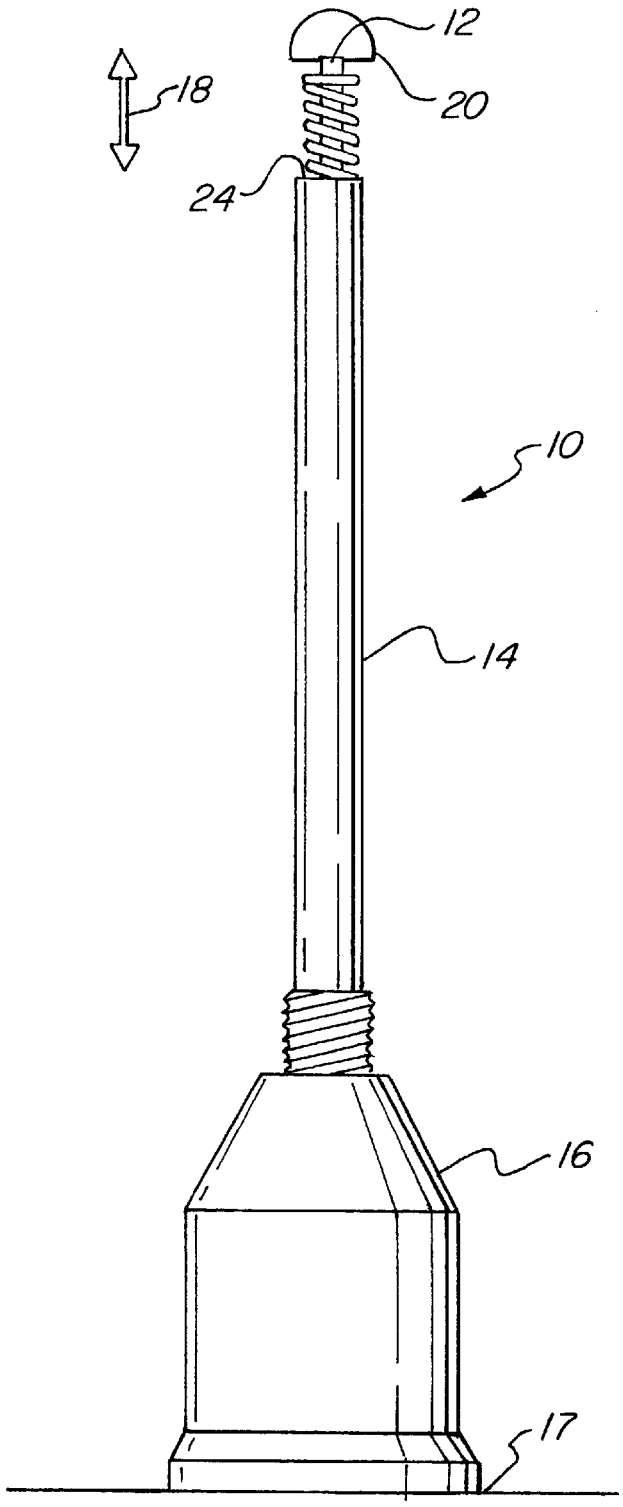
FIG. 1 schematically illustrates an embodiment of the present invention.

FIG. 1 illustrates very generally one embodiment of the present invention. The golf ball teeing apparatus 10 has a body 14 with an elongated rod 12 reciprocally placed therein. Body 14 is threaded onto housing 16. Housing 16 has a perimetrical edge 17. A placement cap 20 is placed on the elongated rod 12 and separated by body 14 by a spring 22. Placement cap 20 is stopped preventing movement of elongated rod 12 when contacting body top end 24. Arrow 18 illustrates the reciprocal movement of elongated rod 12.

Figure 1A:
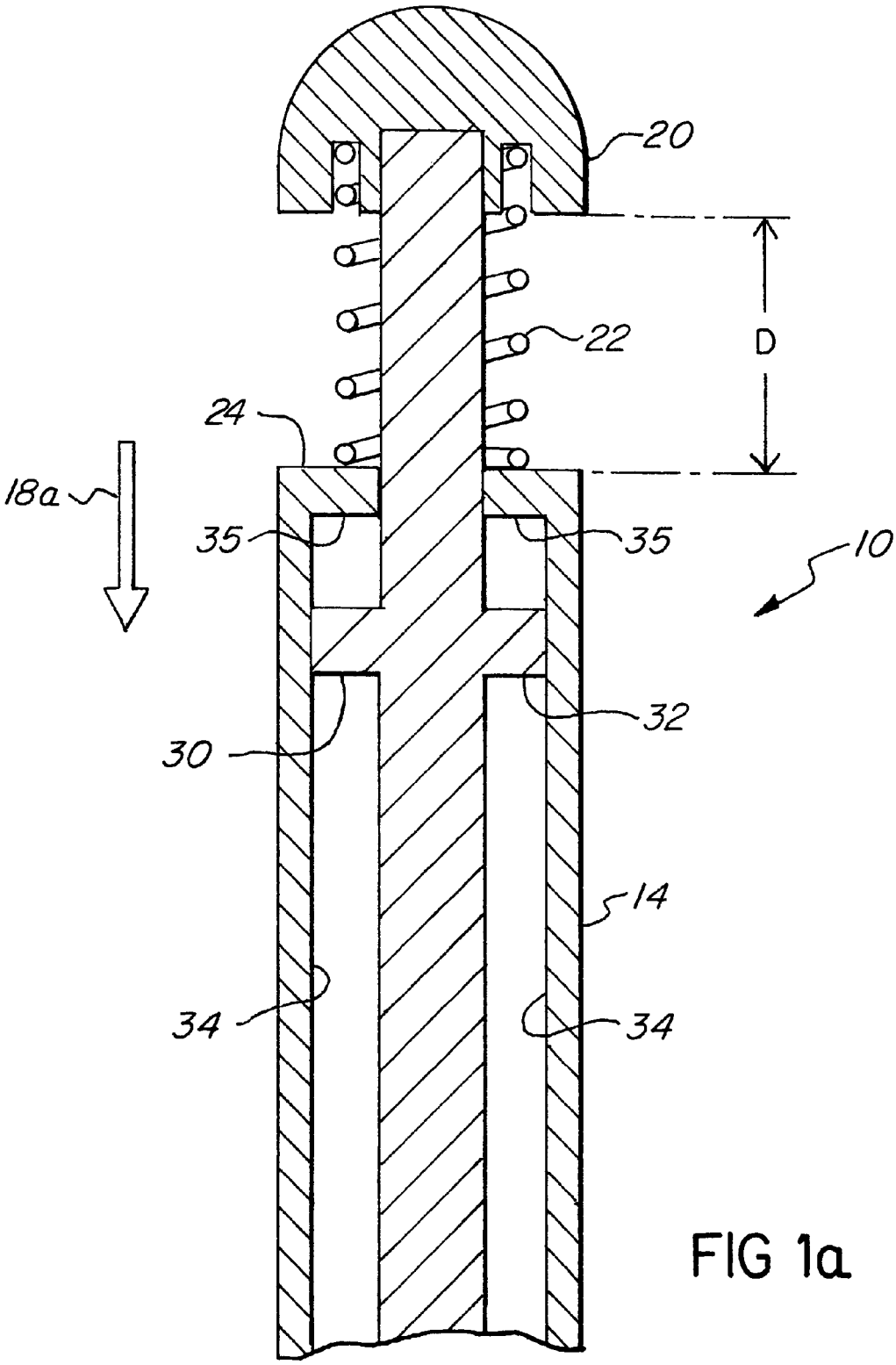
FIG. 1A is a partial cross section illustrating the handle of an embodiment of the present invention.

FIG. 1A illustrates the handle portion of the golf ball teeing apparatus 10. Cap 20 is biased upward by spring 22 a distance D. Extending portions 30 and 32 strike inner walls 35 when extended upward in the direction of arrow 18*b*. Extending portions 30 and 32 are in contact with inner wall 34. Upon depressing the placement cap 20 in the direction of arrow 18*a*, placement cap 20 strikes surface 24.

Figure 1B:
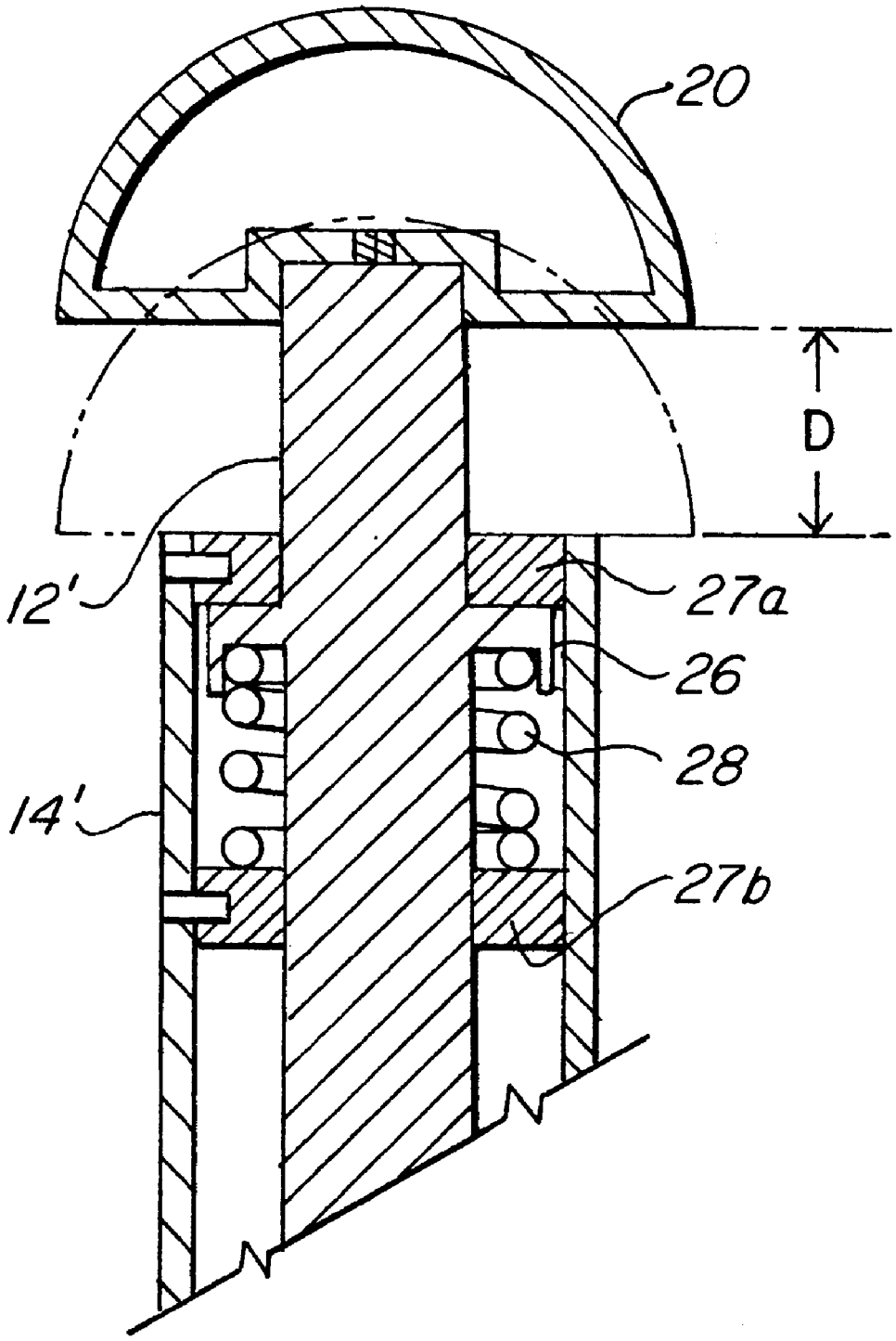
FIG. 1B is a cross section illustrating another embodiment of a handle of the present invention.

FIG. 1B illustrates another embodiment of a handle portion of the present invention. In this embodiment, spring 28 is enclosed within the body 14'. Rod 12' is attached to placement cap 20. Blocking member 27*b* holds spring 28 at the bottom and blocking member 27*a* holds protrusion or lip 26 at the top within the body 14'. Spring 28 is biased upward against protrusion or lip 26 and blocking member 27*a*.

Figure 2:
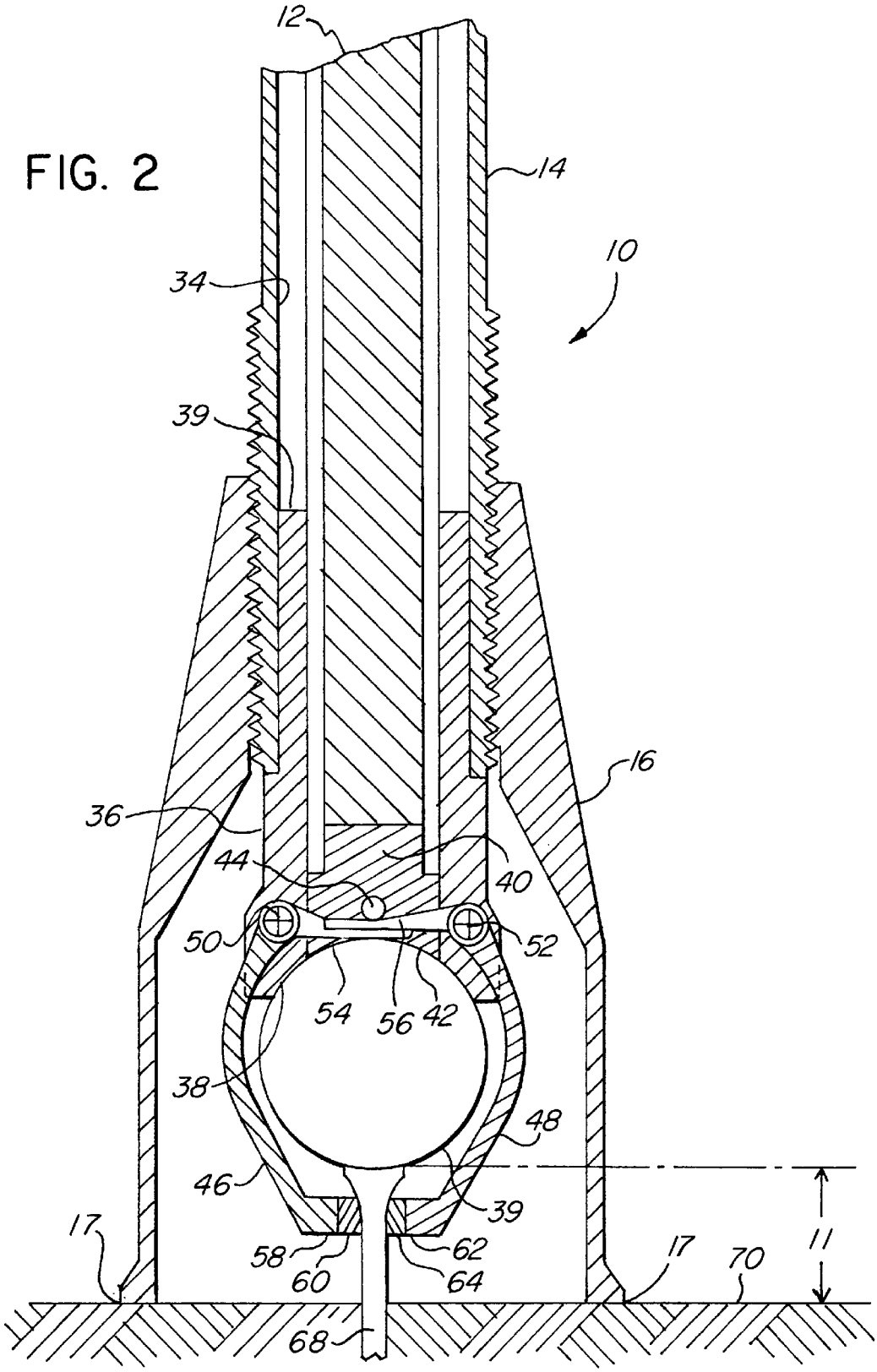
FIG. 2 is a cross section of a portion of an embodiment of the present invention illustrating the golf tee and ball holding mechanism.

FIG. 2 illustrates an embodiment of the golf tee and ball holding portion of the present invention. A bottom surface or end 38 of saddle 36 has a curve matching the curve of a golf ball 39. End portion 40 of rod 12 has a pin 44 therein. Actuator arms 54 and 56 are attached to arms 46 and 48 respectively. Magnets 60 and 64 are placed on the ends 58 and 62 of the arms 46 and 48. The magnets 60 and 64 are shaped to hold a golf tee and are of the appropriate polarity so as to attract. Accordingly, when center rod 12 is pushed downward, arms 46 and 48 release the golf tee 68 and ball 39. Release of the ball begins when the ball is at a height H from the turf or ground 70.

Figure 2A:
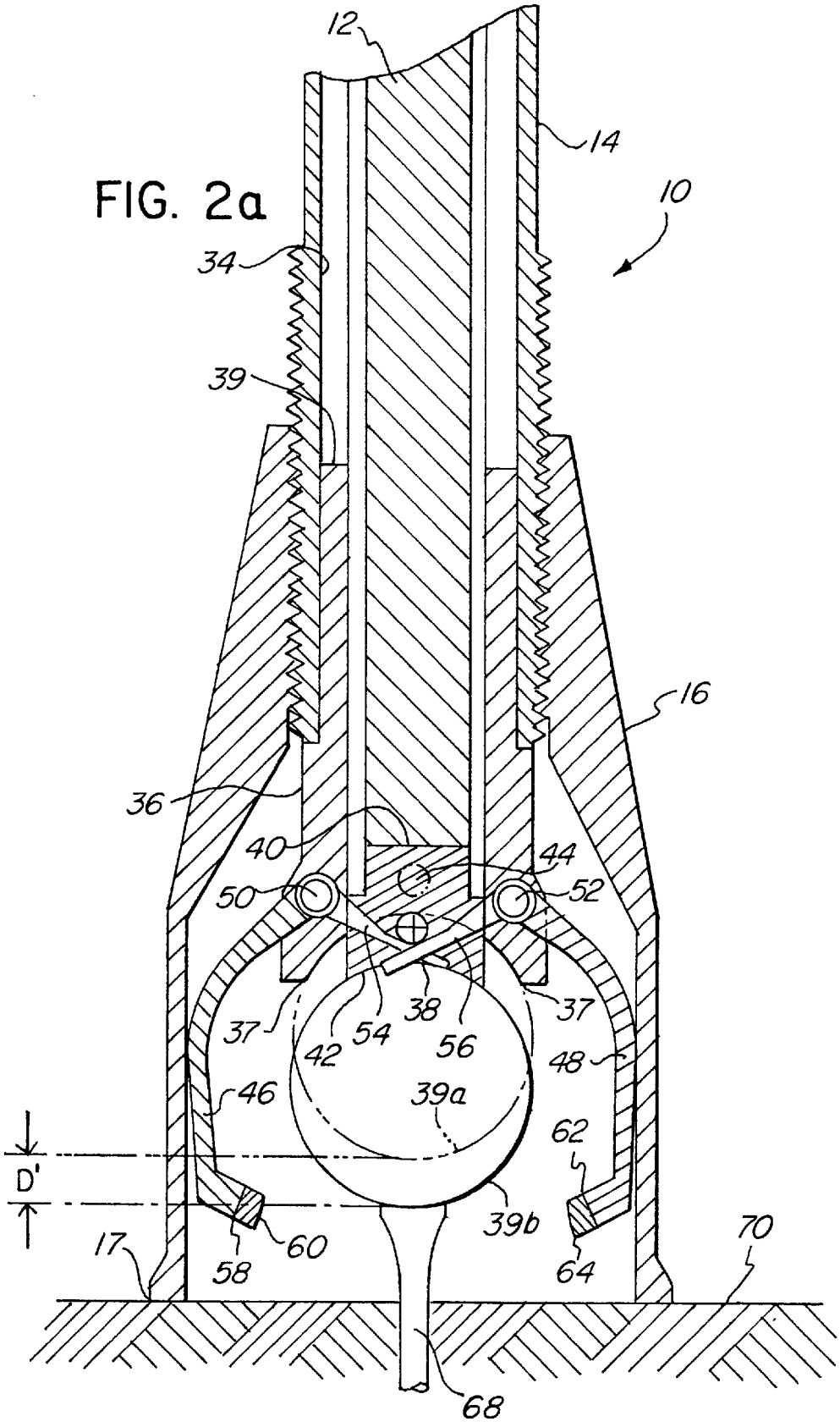
FIG. 2A is a cross section of a portion of the invention illustrated in FIG. 2 in a release position.

FIG. 2A illustrates the downward motion of rod 12 causing the arms 46 and 48 to release the golf tee 68 and ball 39, now at position 39*b*, and formally at position 39*a*. The ball has moved a distance D'.

Figure 2B:
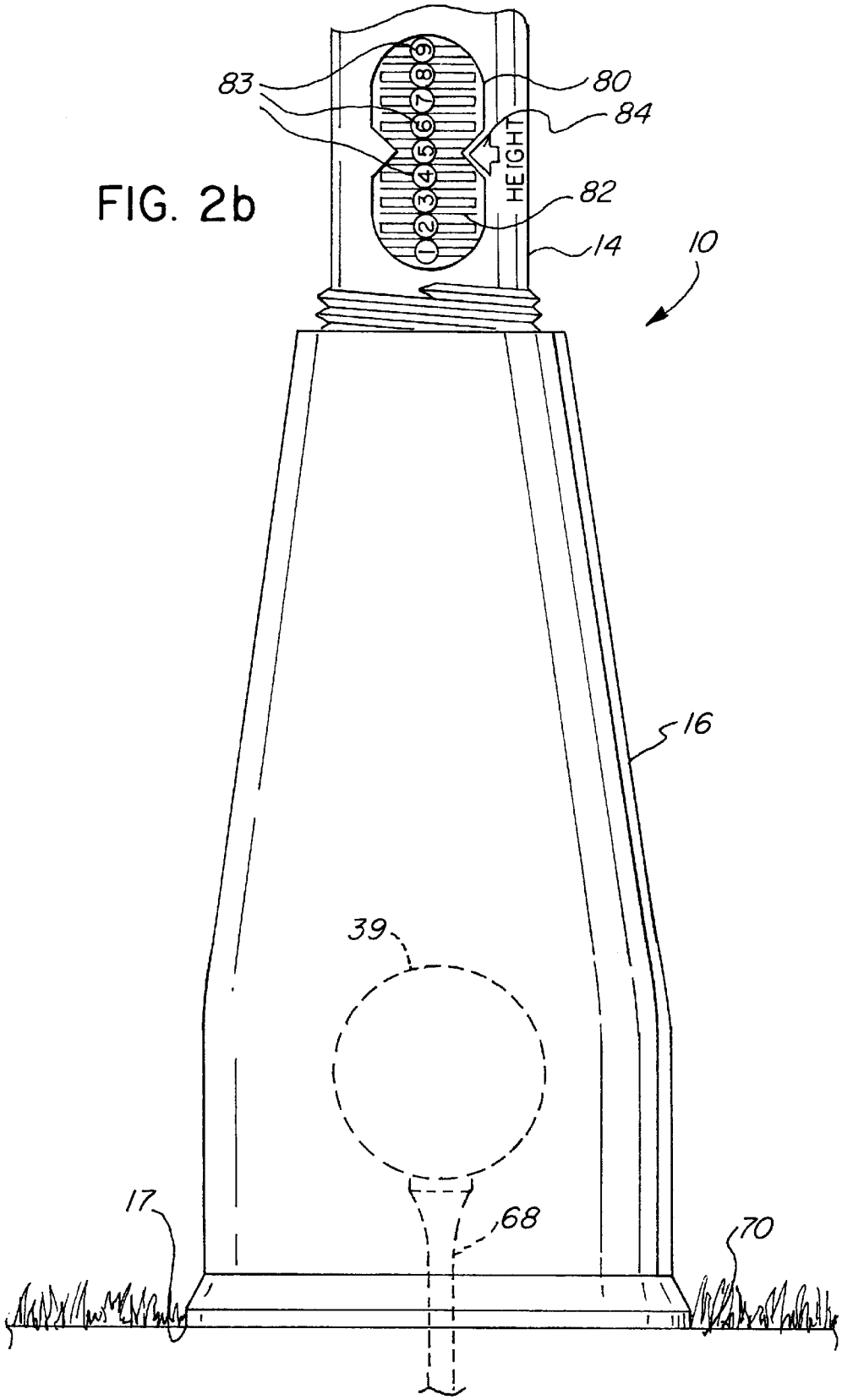
FIG. 2B illustrates an embodiment of a height adjuster.

FIG. 2B illustrates a height adjusting mechanism used with the present invention. A transparent or cut-away window 80 permits viewing of indicia 82 having a scale 83 thereon. Indicator 84 identifies the scale 83 corresponding to a unit of height. The indicia 82 may be placed on the rod.

Figure 3:
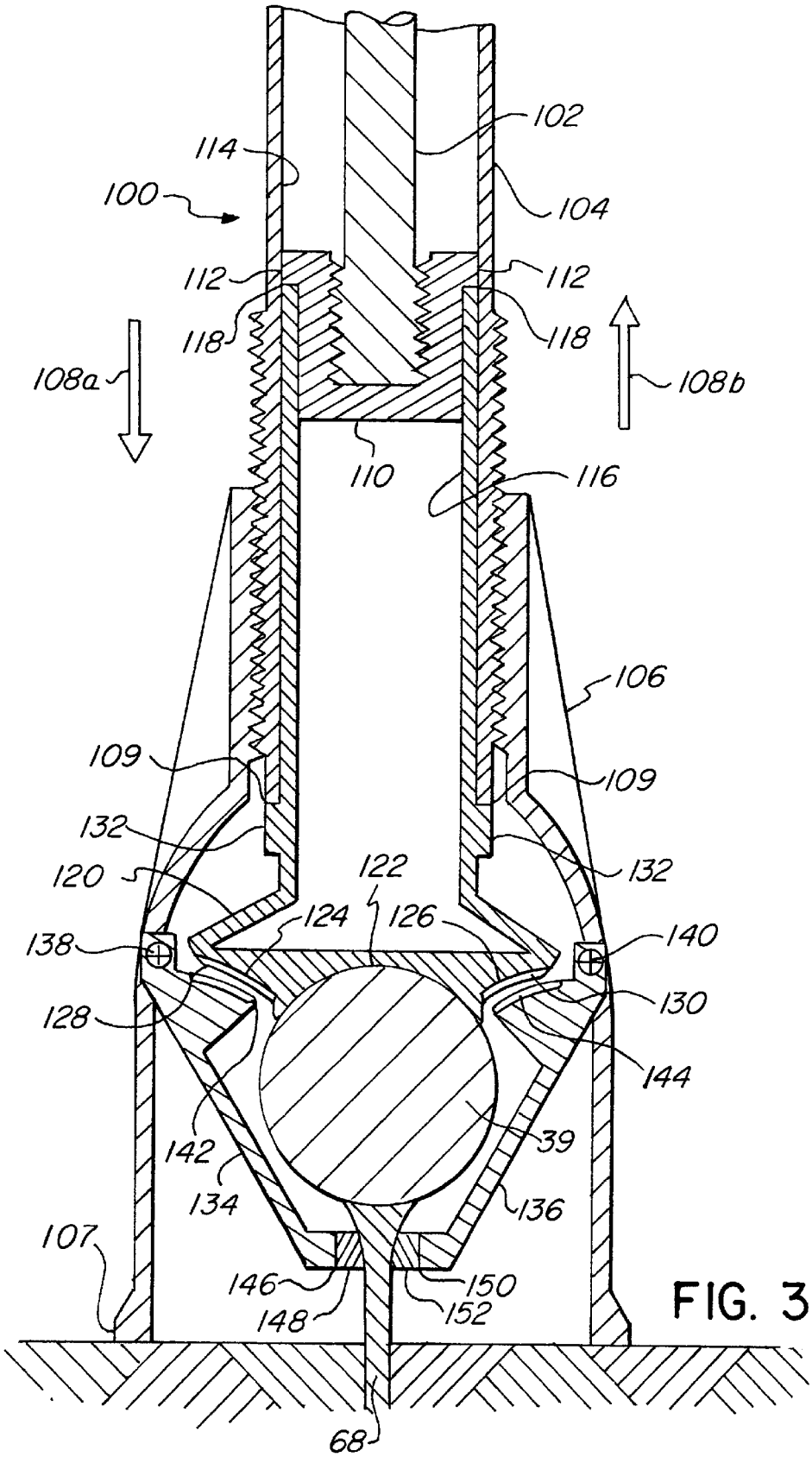
FIG. 3 is a cross section illustrating another embodiment of the golf tee and ball holding portion of the present invention.

FIG. 3 illustrates the golf tee and ball holding portion of another embodiment 100 of the present invention. Rod 102 extends within body 104 having an inner wall 114. Housing 106 is threaded onto the body 104. Housing 106 has an edge 107. Lower portion 120 can move up and down within the housing 106 in the directions of arrows 108*a* and 108*b*. A bottom end 109 contacts extending portion 132 limiting upward movement. Flange or lip 112 attached to end portion 110 contacts the upper end 118. Saddle 116 is attached to lower portion 120. Lower portion 120 has an end 122 thereon that has a concave surface adapted to receive golf ball 39. Adjacent the concave surface or end 122 are surfaces 124 and 126. Surfaces 124 and 126 may have magnets 128 and 130 thereon. Arms 134 and 136 are pivotally attached to housing 106 by pivots 138 and 140 respectively. Arms 134 and 136 have magnets 142 and 144 thereon. The magnets 142 and 144 have a polarity so as to attract magnets 124 and 126 respectively. Ends 146 and 150 of arms 134 and 136 have magnets 148 and 152 thereon. The magnets 148 and 152 are shaped and have a polarity so as to hold golf tee 68. In this embodiment, when lower portion 120 is advanced downwards, arms 134 and 136 are caused to spread apart, releasing golf ball 39 and the golf tee 68. The magnets 128, 130, 142, 144, and 148, 152 help to hold the ball in a set position prior to release.

Figure 4:
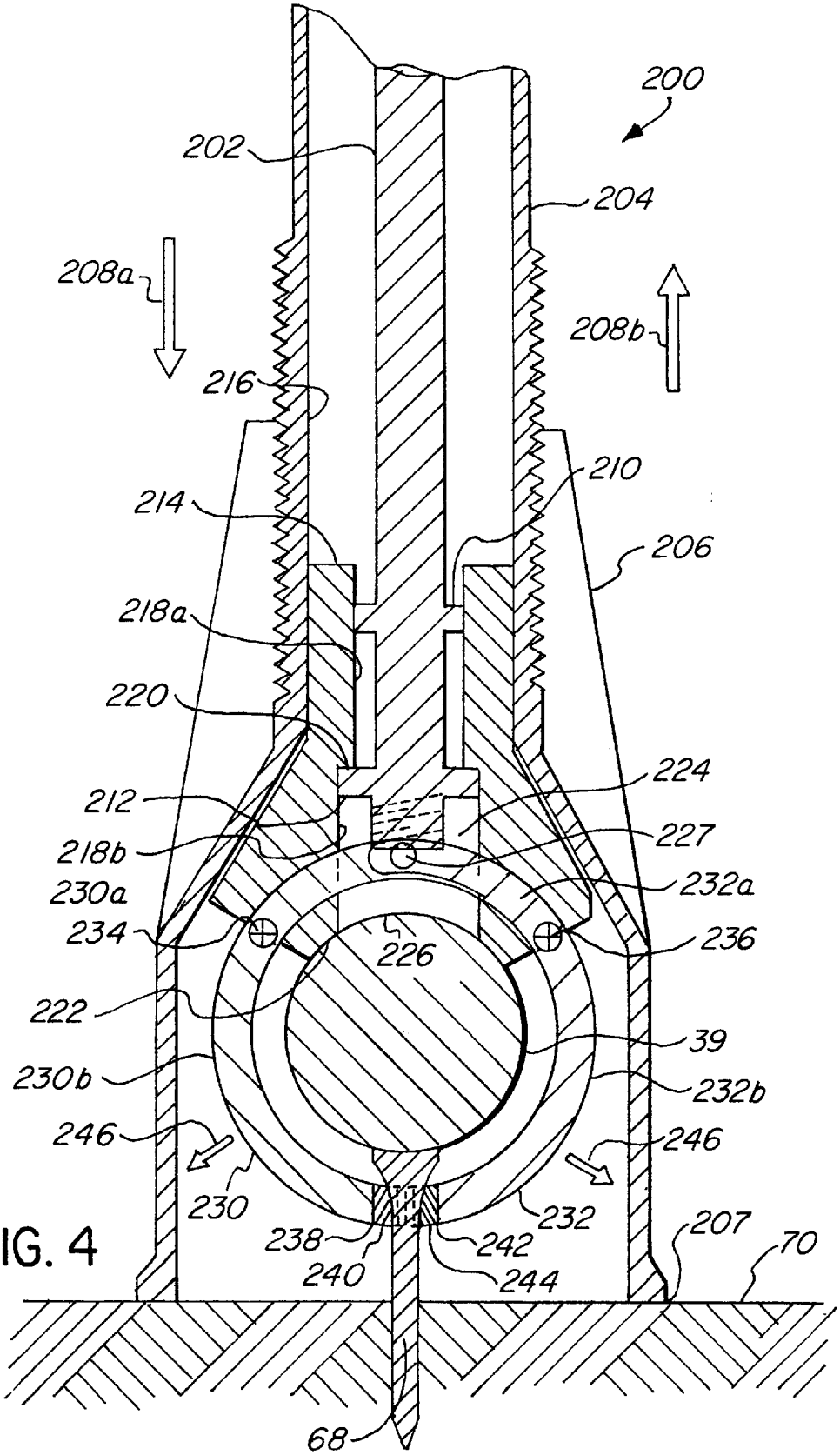
FIG. 4 is a cross section illustrating another embodiment of the golf tee and ball holding portion of the present invention.

FIG. 4 illustrates another embodiment of the ball holding portion of the present invention. The golf ball teeing apparatus 200 has a center rod 202 within a body 204. Body 204 is attached to housing 206. Housing 206 has an edge 207. The rod 202 can reciprocate up and down in the directions of arrows 208*a* and 208*b* within the housing 204. On rod 202 are protruding or extending portions 210 and 212. A saddle 214 retains the extending or protruding portions 210 and 212. A portion of the saddle 214 is held within a wall 216. The saddle has an inner wall portion 218*a* and 218*b*. Wall or shoulder 220 of saddle 214 contacts protruding portion 212 and prevents upward movement. Bottom portion 222 has a curved shape adapted to mate with the golf ball 39. End portion 224 includes a pin 227. Golf tee holder arms 230 and 232 are pivoted to saddle 214 by pivot pins 234 and 236. The golf tee holder arms 230 and 232 have an upper portion 230*a* and 232*a* and a lower portion 230*b* and 232*b*. Ends 238 and 242 have magnets 240 and 244 thereon. The magnets have a shape and polarity so as to hold the golf tee 68. The pivot pin 227, upon being advanced downward, causes the arms 230 and 232 to move outward in the directions of arrow 246. The golf tee 68 and ball 39 are thereby released with the tee 68 in the ground 70.

Figure 5:
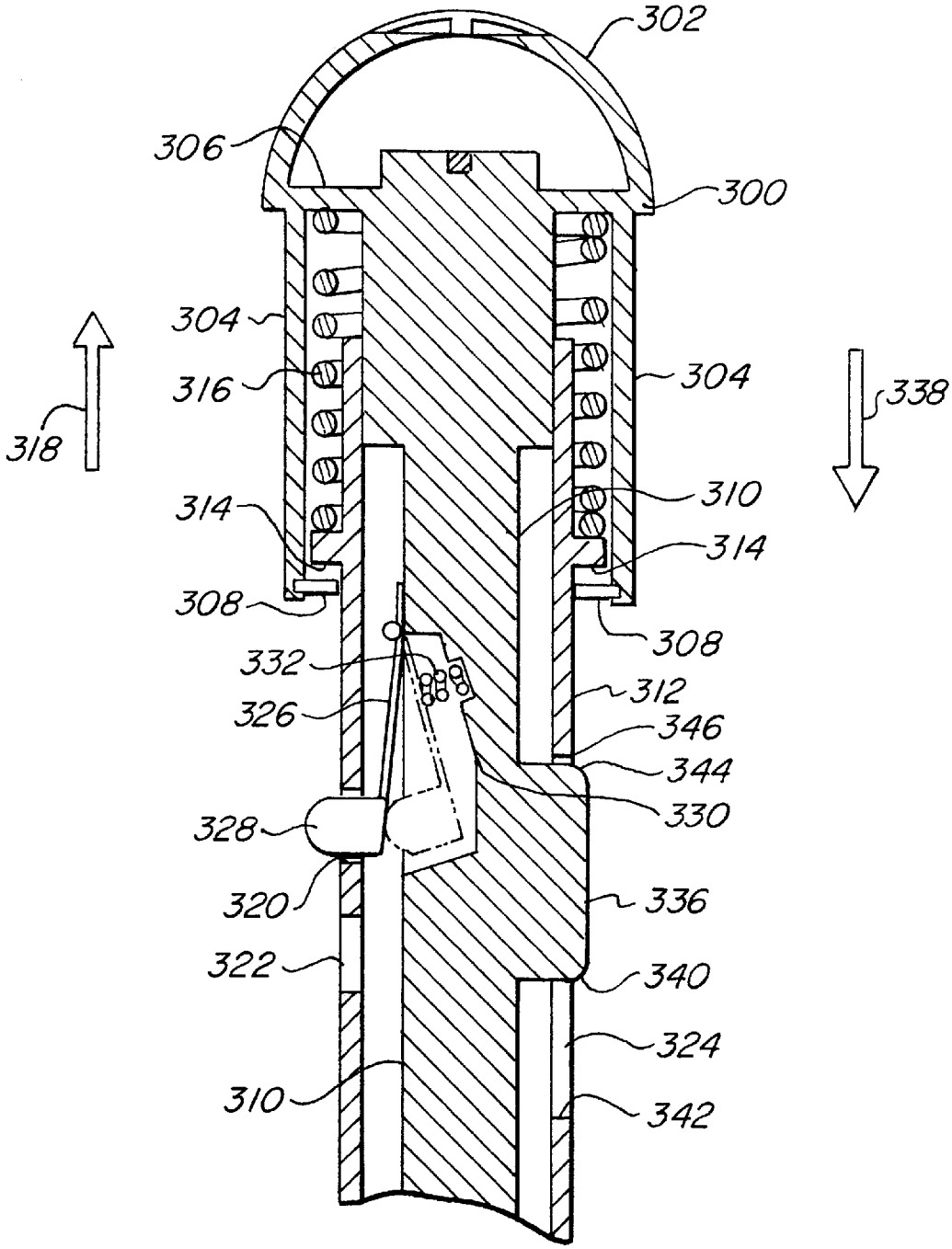
FIG. 5 is a cross section illustrating another embodiment of the handle portion of the present invention.

FIG. 5 illustrates another embodiment of the handle portion of the present invention. A cap 300 has a top 302. Inner wall 306 is connected to a wall 304. Wall 304 has a block member 308 attached thereto at one end. Rod 310 is held within a body 312. Body 312 has lips or protrusions 314 thereon. Lips or protrusions 314 hold spring 316 at the bottom portion thereof. Spring 316 is retained at the top portion by inner wall 306. Body 312 has openings 320 and 322 therein for receiving a knob 328. The knob 328 is pivotally connected to the rod 310 and biased outward by spring 332 pushing on lever 326. When retracted, the knob 328 is held within recess 330. Extending portion 336 extends through slot 324 and has a bottom surface or edge 340 and a top edge or surface 344. The top edge 344 contacts edge 346 and the bottom edge contacts edge 342. The protrusion 336 prevents rod 310 from traveling too far in the direction of arrows 318 and 338. The use of the knob 328 in combination with the openings 320 and 322 permit the golf ball and tee holding portion to be set in different positions.

While the embodiments illustrated in FIGS. 1 through 5 are desirable, their structure is relatively complicated and often difficult to manufacture. The following embodiments are believed to be of simpler design and more easily manufactured. Additionally, the following embodiments have proven by experimentation to achieve a more desirable ball release.

Figure 6:
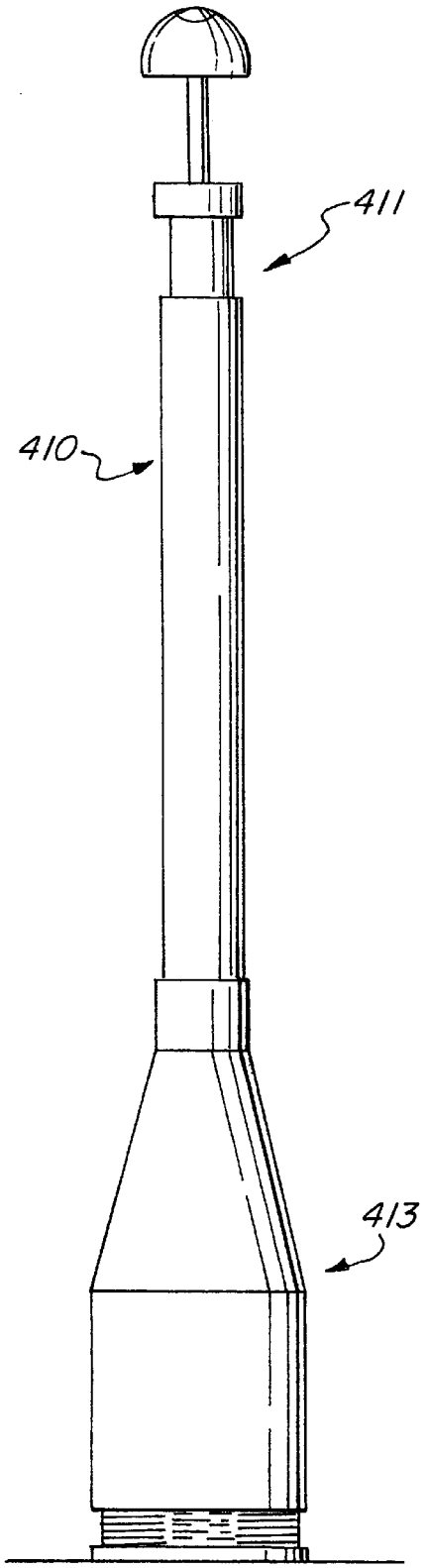
FIG. 6 is a side elevation view of another embodiment of the present invention.

FIG. 6 illustrates another embodiment of a golf tee and ball placement device 410 having a reciprocating handle portion 411 and a golf tee and ball holding portion 413.

Figure 7:
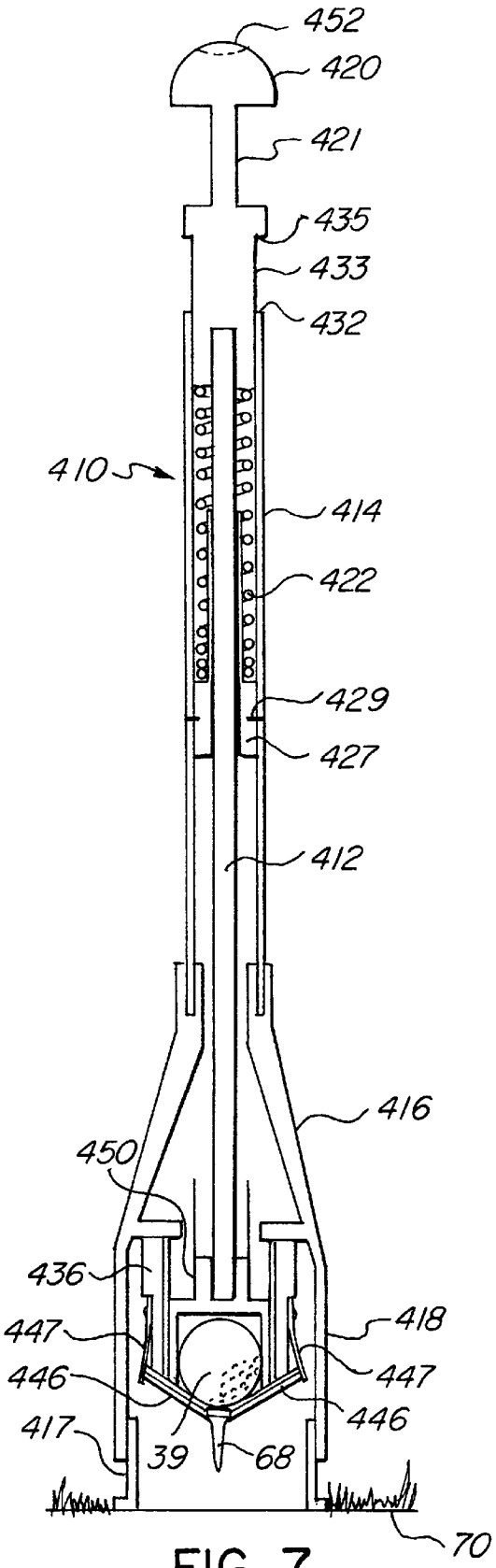
FIG. 7 schematically illustrates the internal operation of the embodiment illustrated in FIG. 6.

FIG. 7 schematically illustrates the internal operation of the golf tee and ball placement device 410. A main tube body 414 has an actuator rod 412 coaxially positioned therein. Attached to the main tube body 414 is an upper conical housing 416. Attached or formed as part of the upper conical housing 416 is a lower cylindrical housing 418. Movable within the lower cylindrical housing 418 is a threaded height adjuster 417. The threaded height adjuster 417 should have a sufficient diameter so as to be stable on the ground or turf 470. On the other end of the main tube body 414 is placed a domed push button 20 having a stem 421 connected thereto. A bubble level 452 may be placed on the domed push-button 420. The bubble level 452 helps the user maintain the golf tee and ball placement device 410 vertical and substantially perpendicular to the ground or turf 70. Motion slide 433 is connected to stem 421 and received within one end of the main tube body 414. A spring 422 is positioned around the actuator rod 412 and biases the motion slide 433 upward. The spring 422 is retained at the bottom by lower spring retainer 427 which is attached to the main tube body 414 by a fastener, screw, or lock pin 429. The motion slide 433 has a stop collar 435. Stop collar 435 contacts tube top surface 432 when advanced downward against the biasing force of spring 422. Equivalent stop means may be employed such as those disclosed in the other embodiments of the present invention or known equivalents. For example, a concentric tube portion may be attached to the lower spring retainer 427 and motion slide 433 such that the distance between the concentric tube portions is the predetermined distance of motion such that when the respective ends meet, it acts as a stop. On the other end of actuating rod 412 is positioned a ball holder or guide 450. Ball holder 450 has a cylindrical portion holding a golf ball 39. The ball holder 450 slides within an arm base 436. Pivotally connected to the arm base 436 are arms 446. Arms 446 have an opening therein to hold a golf tee 68. The arms 446 are held in position against the golf ball 39 and the golf tee 68 by leaf springs 447.

Figure 8A:
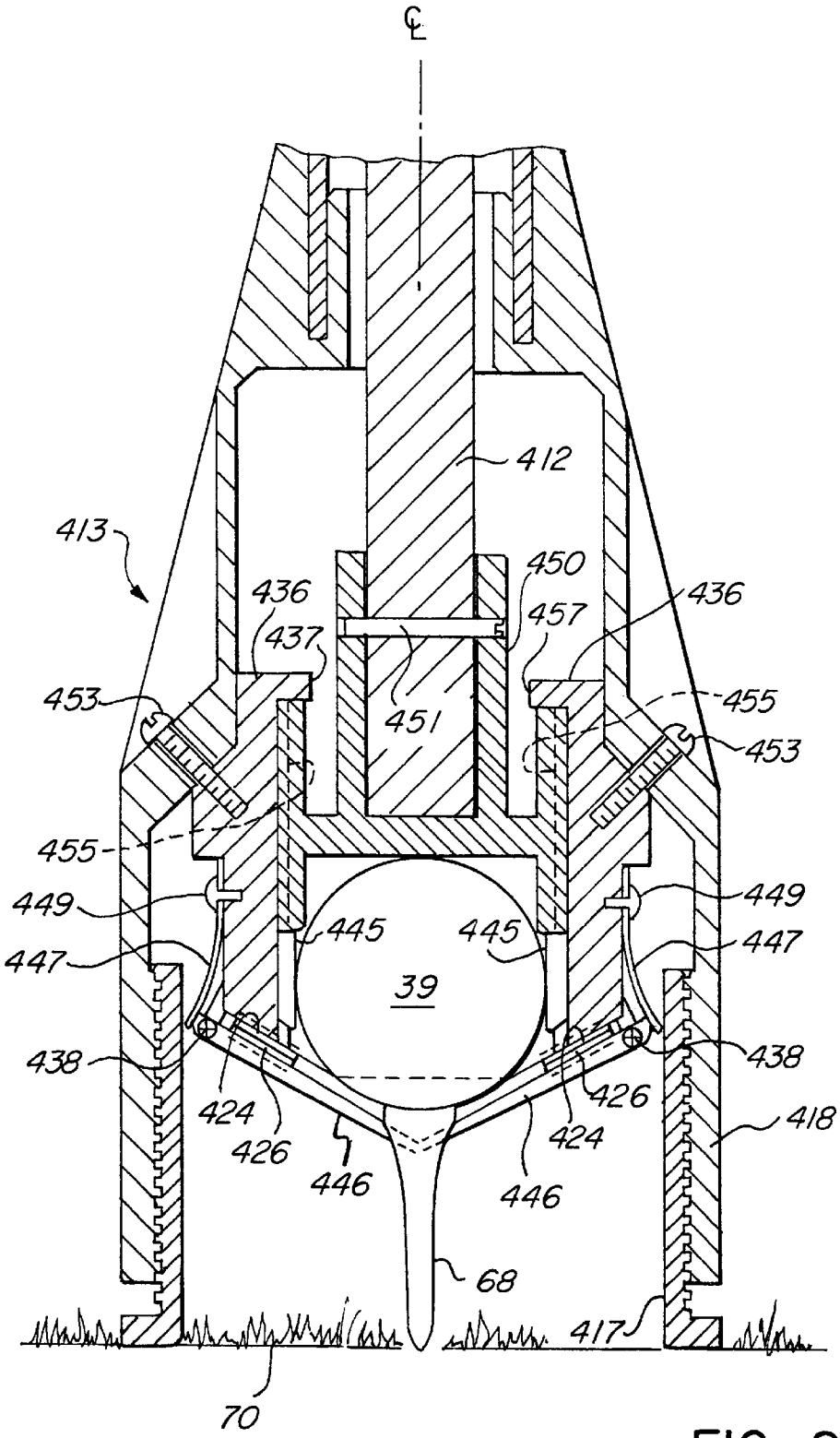
FIG. 8*a* illustrates another embodiment of the golf tee and ball holding portion of the present invention.

FIG. 8*a* more clearly illustrates the golf ball and tee holding portion 413. Actuator rod 412 is attached to the ball holder or guide 450 by screw 451. A channel in the cylindrical ball holder or guide 450 slides within key 455 on arm base 436. This guides the ball holder 450 when moving up and down. A portion of the side walls of the cylindrical ball holder or guide 450 is cut away forming a cut away portion 455. The cut away portion 455 if the side walls of the cylindrical ball holder or guide 450 has a width sufficient to permit the arms 446 to fit therein. The arm base 436 is attached to the lower cylindrical housing 418 by screws 453. Arm base 436 has shoulders 437 for retaining the ball holder or guide 450. Spring clips or leaf springs 447 are attached to the arm base 436 by fasteners 449. The distal end of the spring clips or leaf springs 447 contact an end of arms 446. Arms 446 are pivotally connected to the arm base 436 by pivots 438. The other end of arms 446 hold golf tee 68. The arms 446 have portions of a hole or semi-circles therein such that when the arms 446 are mated they securely hold golf tee 68. Additionally, the holes may be beveled to provide a broader contact surface against the tee 68. Magnets 424 of one polarity are attached to arm base 436 and correspond or match magnets 426 of an opposite polarity or pole attached to arms 446. The magnets 424 and 426 help to hold arms 446 in a retaining position to hold the golf tee 68 and ball 39 in position within the ball holder or guide 450. While magnets are illustrated, it should be appreciated that other equivalent holding means, such as for example sticky tape, snaps, or hook and loop fasteners, may be used. The height of the teed position of the ball is adjusted by threading threaded height adjuster 417 within the lower cylindrical housing 418.

Figure 8B:
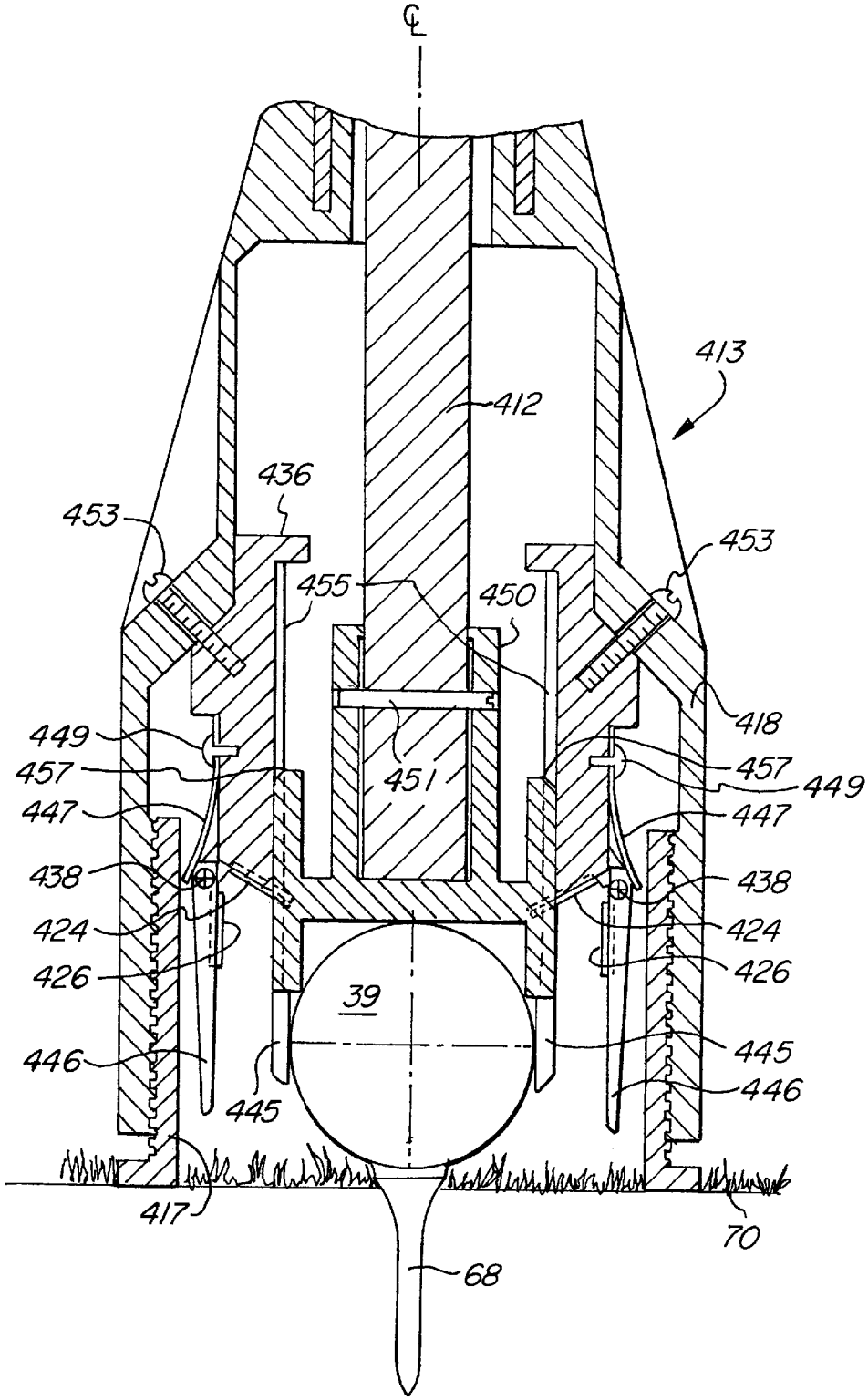
FIG. 8*b* illustrates the golf tee and ball holding portion illustrated in FIG. 8*a* in a release position.

FIG. 8*b* illustrates the golf tee and ball placement device in a release position with the golf tee 68 being partially imbedded in the turf or ground 70 with the golf ball 39 placed thereon. As illustrated in FIG. 8*b*, when the actuator rod 412 is pushed downward advancing the ball holder 450, the ball holder and guide 450 causes the arms 446 to pivot outward releasing the golf tee 68 and ball 39. The ball holder or guide 450 rides within groove or channel 457 and key 455 on the arm base 436. The cut away portions 445 aids in facilitating movement of the arms 446 and contributes to the controlled release of the golf ball 39. After setting of the golf tee 68 and golf ball 39 in a teed position, the actuator rod 412 is raised upward, withdrawing the ball holder 450 without moving arms 446. Accordingly, the arms 446 do not interfere or come close to the golf ball after the ball guide or holder 450 is withdrawn, thereby greatly eliminating the possibility that the golf ball 39 will fall or be knocked off the tee upon removing the golf tee and ball placement device. This is a common problem in prior devices where an actuating member is in contact or linked to the arms used to hold the golf tee or golf ball. Once the golf tee and golf ball have been positioned and the golf tee and golf ball placement device removed, another ball can be positioned within the ball holder and guide 450 and the arms 446 easily reset into a holding position.

Figure 9A:
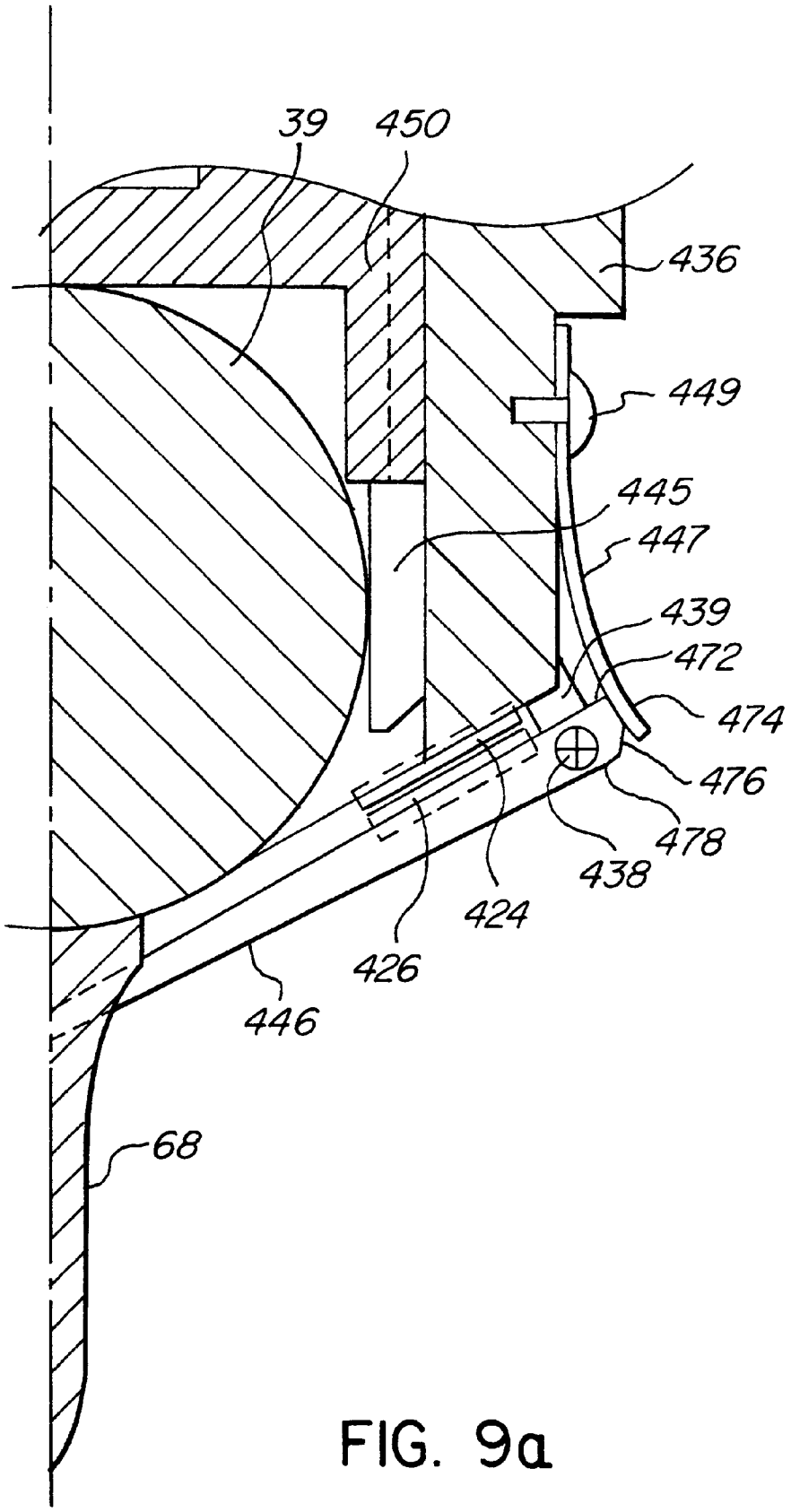
FIG. 9*a* illustrates one half of the golf tee and ball holding portion in greater detail.

FIG. 9*a* illustrates a section of one-half of the golf ball and tee holding portion 413 illustrated in FIGS. 8*a* and 8*b*. FIG. 9*a* more clearly illustrates the interaction between the spring clip or leaf spring 447 and the arms 446. Arm 446 has a plurality of surfaces that contact the spring clips or leaf spring 447. When arm 446 is in a retaining position, flat surface 474 rests broadly on the surface of the spring clip or leaf spring 447. This helps retain the arm 446 in a holding position. Adjacent or an one side of flat surface 474 is a flat surface 472 substantially perpendicular to flat surface 474. Adjacent to the other side of flat surface 474 is a camming surface 476 that is curved. Adjacent the other side of the camming surface 476 is a flat surface 478. The camming surface 476 aids in the release or swinging of the arm 446 when the golf tee 68 and ball 39 are being released. The flat surface 472 helps hold the arm 446 against the flat surface of arm base 436, as does the flat surface 478 adjacent the surface of the spring clip or leaf spring 447. Accordingly, after being released, the arm 446 is held away from the golf ball 39 so that upon removing the golf tee and ball placement device, the arm 446 is well away from the golf ball 39, preventing any knocking or jarring which could cause the golf ball 39 to topple or fall off of the golf tee 68 after placement. FIG. 9*a* also more clearly illustrates a pivot mount 439 attached to the arm base 436 for holding the pivot 438. There are two pivot mounts 439 for each arm 446.

Figure 9B:
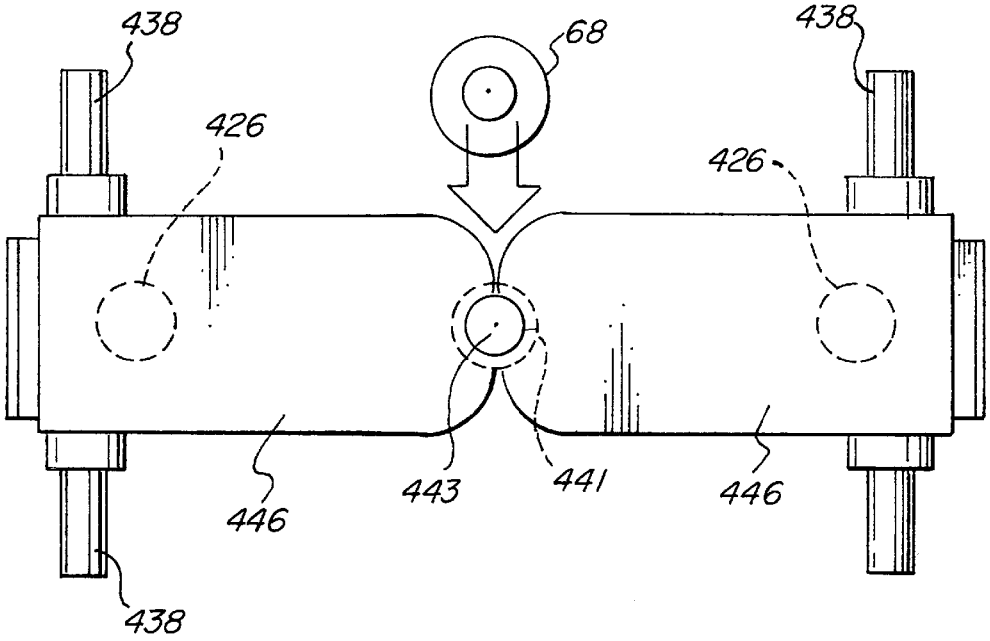
FIG. 9*b* is a bottom plan view illustrating the arms for holding a golf tee.

FIG. 9*b* more clearly illustrates the shape of the arms 446. A pivot mount, not illustrated, holds each end of the pivots 438. The distal ends of the arms 446 are preferable curved to facilitate placement of the golf tee 68 within the opening formed at the distal ends of the arms 446. The golf tee 68 is placed within the opening 443. The perimeter of opening 443 may have a bevel 441 to aid in holding the golf tee 68.

Figure 10:
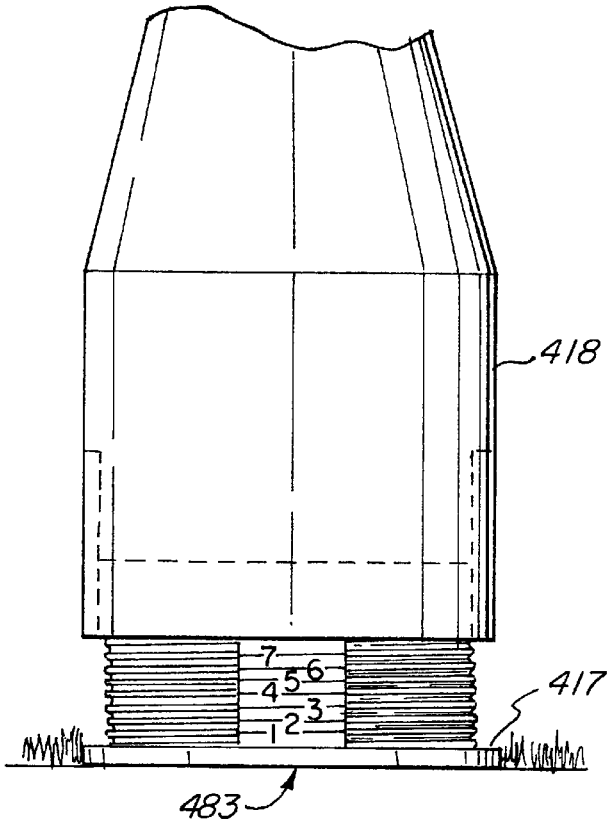
FIG. 10 illustrates another embodiment of the height adjusting portion of the present invention.

FIG. 10 more clearly illustrates the height adjusting mechanism of the present invention. The threaded height adjuster 417 has indicia 483 thereon. The threaded height adjuster 417 is threaded into internal threads on the lower cylindrical housing 418. The bottom of the lower cylindrical housing 418 then acts as a reference from which the indicia 483 can be read. The height adjusting mechanism results in accurate and repeatable positioning of a golf ball or a golf tee depending upon the preference of the user or golfer.

Figure 11:
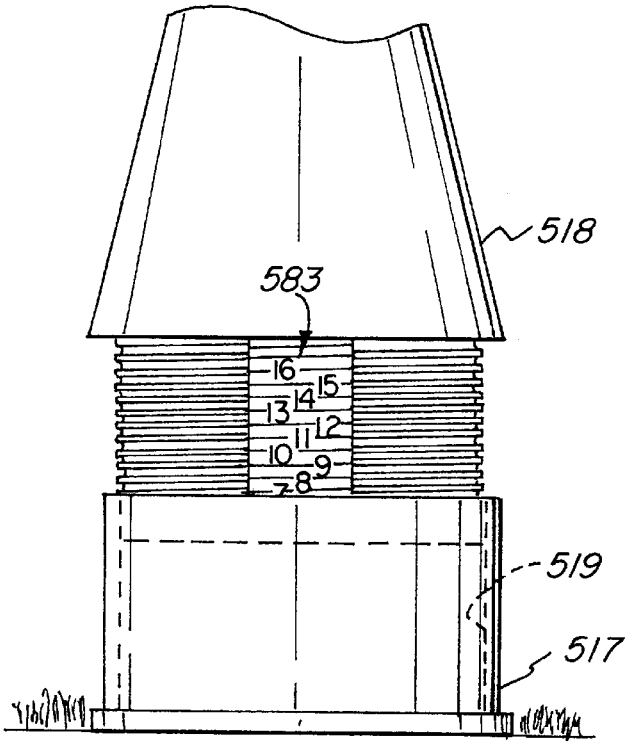
FIG. 11 illustrates another embodiment of the height adjusting portion of the present invention.

FIG. 11 illustrates another embodiment of a height adjuster. In this embodiment, housing 518 has a plurality of male threads which are threaded into internal female threads 519 on the height adjuster 517. The indicia 583 can then easily be read with reference to the top of the height adjuster 517. It should be appreciated that many other equivalent structure or methods may be utilized to adjust and determine the height the golf tee extends from the ground.

Figure 12:
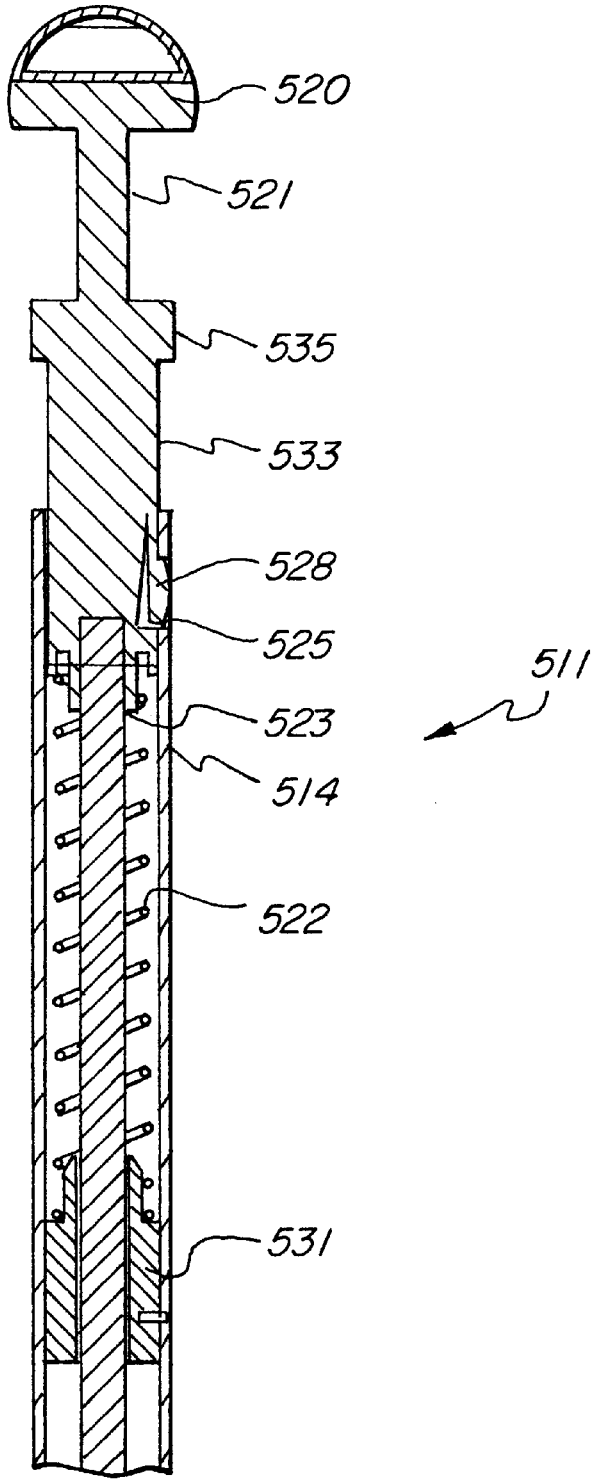
FIG. 12 illustrates another embodiment of the handle portion of the present invention.

FIG. 12 illustrates another embodiment of a handle portion 511 of the present invention. This embodiment of the handle portion 511 utilizes a button 528 to prevent the unintentional release of a golf ball and tee once retained or set. A domed push button 520 is attached to a stem 521 and a motion slide 533. Motion slide 533 has a button 528 attached with an integral or living hinge. The button 528 is sized to fit through an opening 525 within the main tube body 514. One end of the motion slide 533 has a top spring retainer 523 with a spring 522 concentrically placed thereover. The other end of the spring 522 is concentrically placed over a bottom spring retainer 531 which is subsequently attached to the ball and tee holding portion, not illustrated. In order to lower the dome d push button 520 to release a golf ball and tee that have been set, button 528 must be depressed. Accordingly, button 528 may be utilized to prevent the unintentional depression of the domed push button 520, resulting in the release of the retained golf ball and golf tee.

The present invention and the various different embodiments illustrated greatly improves the ease and accuracy in which a golf ball can be placed or set on a golf tee. The present invention can be easily set with a golf ball retained securely prior to being positioned or teed up. The use of retaining arms that are released and held in a position away from the golf ball upon removal of the golf tee and ball placement device greatly reduces the likelihood that the golf ball will topple off of the golf tee upon removal of the golf tee and ball placement device. The present invention, therefore, eliminates much of the frustration associated with prior devices which have been difficult to use and have a low degree of consistent and accurate placement of a golf ball on a tee. Accordingly, the present invention is applicable to a variety of situations where a user places a golf ball on a golf tee. For example, on a golf course, at a driving range, in a field, or practicing golf anywhere. Additionally, the present invention is useful for a golfer of any age to avoid having to bend over.

While the present invention has been described with respect to various embodiments, clearly modifications and variations may be made without departing from the spirit or scope of the invention.

What is claimed is:

1. A device used to place a golf ball and golf tee comprising:

a housing;

a golf ball holder movably placed within said housing;

an actuator rod attached to said golf ball holder;

an arm base attached to said housing; and an arm pivotally attached to said arm base adapted to releasably hold a golf tee and golf ball within said golf ball holder and positioned so as to release the golf ball and golf tee upon movement of said golf ball holder by said actuator rod, whereby the golf ball and golf tee are held within said golf ball holder by said arm and released when said golf ball holder is moved by said actuator rod causing the golf ball to remain on the golf tee placed in the ground.

2. A device used to place a golf ball and golf tee as in claim 1 further comprising:

a spring biasing said actuator rod away from said housing.

3. A device used to place a golf ball and golf tee as in claim 1 further comprising:

means for adjusting the placement height of the golf tee.

4. A device used to place a golf ball and golf tee as in claim 3 wherein:

said means for adjusting the placement height of the golf tee comprises a threaded height adjuster attached to said housing.

5. A device used to place a golf ball and golf tee as in claim 1 further comprising:

a spring clip attached to said housing and contacting said arm, whereby said arm is held in a predetermined position.

6. A device used to place a golf ball and golf tee as in claim 1 further comprising:

a first magnet placed on said arm base; and a second magnet, having a pole to attract said first magnet, placed on said arm.

7. A device used to place a golf ball and tee comprising:

a tube body;

an actuator rod placed within said tube body;

a cylindrical golf ball holder placed on one end of said actuator rod;

a push-button placed on the other end of said actuator rod;

a housing placed around said cylindrical golf ball holder and attached to said tube body;

a pair of arms each having a width pivotally attached to said housing and positioned to be released when said cylindrical golf ball holder is pushed downward by said actuator rod, said pair of arms being de-coupled from said cylindrical golf ball holder after the golf ball and tee are released by said pair of arms, whereby a golf ball is placed on a golf tee and prevented from falling off upon removal of the device used to place a golf ball and tee.

8. A device used to place a golf ball and tee as in claim 7 further comprising:

a height adjuster attached to said housing.

9. A device used to place a golf ball and tee as in claim 7 further comprising:

an arm base attached to said housing, said cylindrical golf ball holder sliding axially on said arm base;

a pair of spring clips attached to said arm base, one each of said pair of spring clips contacting an end of one each of said pair of arms, whereby said pair of arms releasable hold the golf ball within said cylindrical golf ball holder and the golf tee adjacent the golf ball.

10. A device used to place a golf ball and tee as in claim 7 further comprising:

a first pair of magnets placed on said arm base; and a second pair of magnets, having a pole to attract said first magnet, placed on said pair of arms.

11. A device used to place a golf ball and tee as in claim 7 further comprising:

a pair of cut away portions in the cylindrical walls of said cylindrical golf ball holder, each of said pair of cut away portions having a width adapted to receive the width of each of said pair of arms.

12. A device used to place a golf ball and tee as in claim 9 further comprising:

a cam surface placed on the end of one each of said pair of arms, whereby the pair of arms are controllably moved from a retaining position to a releasing position.

13. A device used to place a golf ball and tee as in claim 7 further comprising:

a hole placed in said tube body; and a button lock attached to said actuator rod and adapted to be received by said hole when said actuator rod is in a predetermined position.

14. A device used to place a golf ball on a golf tee at a predetermined height without the user or golfer having to bend over comprising:

an elongated tube body;

an actuator rod placed within said elongated tube body;

a cylindrical ball holder placed on one end of said actuator rod, said cylindrical ball holder having a plurality of cut away portions in the cylindrical wall;

a push button placed on the other end of said actuator rod;

a motion slide attached to said push button, said motion slide fitting within said elongated tube body;

a button connected to said motion slide and biased radially outward towards said elongated tube body;

a hole in said elongated tube body adapted to receive said button, whereby said button extends from said hole locking said actuator rod in a predetermined position;

a housing placed around said ball holder and attached to said body;

a spring biasing said actuator rod away from said housing;

an arm base attached to said housing;

a pair of arms each having a width adapted to be received within the cut away portions in the cylindrical wall of said cylindrical golf ball holder, said pair of arms pivotally attached to said housing and positioned to be released when said ball holder is pushed downward by said actuator rod;

a pair of spring clips attached to said arm base, each of said pair of spring clips contacting one end of said pair of arms;

a first pair of magnets attached to said arm base;

a second pair of magnets, having a pole to attract said first pair of magnets, and positioned on said pair of arms to mate with said first pair of magnets when said pair of arms are positioned to retain the golf ball within said cylindrical golf ball holder; and a height adjuster threaded into said housing;

whereby the golf ball and golf tee are held within said housing by the action of said pair of arms, said pair of spring clips and said first and second pair of magnets until said actuator rod is moved downward releasing the golf ball and tee resulting in the golf ball being teed up at a predetermined height ready to be hit by a golf club without the user or golfer having to bend over.

15. A device for placing a golf ball on a tee comprising:

a housing;

golf ball holder means, placed within said housing, for holding the golf ball;

retainer means, placed adjacent said golf ball holder means, for retaining the golf ball within said golf ball holder means and holding the golf tee adjacent said golf ball, said retainer means being de-coupled from said golf ball holder means once the golf ball and golf tee are released; and actuator means, attached to said housing, for actuating the release of said retainer means, whereby a golf ball is placed on a golf tee.

16. A device for placing a golf ball on a tee as in claim 15 further comprising:

height adjuster means, attached to said housing, for adjusting the height the golf tee is placed in the ground.

* * * * *